US007942088B2

(12) United States Patent
Grenier et al.

(10) Patent No.: US 7,942,088 B2
(45) Date of Patent: May 17, 2011

(54) ANVIL FOR A ROTARY CUTTING UNIT AND A ROTARY CUTTING UNIT HAVING SUCH ANVIL

(75) Inventors: Gilbert Grenier, Annonay (FR); Dirk Harste, Hamburg (DE)

(73) Assignee: Sandvik Intellectual Property AB, Sandviken (SE)

( * ) Notice: Subject to any disclaimer, the term of this patent is extended or adjusted under 35 U.S.C. 154(b) by 917 days.

(21) Appl. No.: 11/165,485

(22) Filed: Jun. 24, 2005

(65) Prior Publication Data

US 2006/0048616 A1 Mar. 9, 2006

(30) Foreign Application Priority Data

Jul. 2, 2004 (SE) ..... 0401735

(51) Int. Cl.
*B26D 7/26* (2006.01)
*B26F 1/38* (2006.01)

(52) U.S. Cl. ..... 83/344; 83/346; 83/506

(58) Field of Classification Search ..... 83/324–349, 83/368, 659, 663, 673, 506, 563, 911, 886–887, 83/698.61, 501–503
See application file for complete search history.

(56) References Cited

U.S. PATENT DOCUMENTS

| | | | | | |
|---|---|---|---|---|---|
| 1,984,913 | A * | 12/1934 | Biggert, Jr. | ..... | 83/288 |
| 3,448,684 | A * | 6/1969 | Faudemay et al. | ..... | 100/171 |
| 4,205,596 | A * | 6/1980 | Chesnut | ..... | 493/370 |
| 4,359,919 | A * | 11/1982 | Fuchs et al. | ..... | 83/349 |
| 4,381,688 | A | 5/1983 | Hardy | | |
| 4,756,219 | A | 7/1988 | Pohl et al. | | |
| 4,926,666 | A * | 5/1990 | Gotting et al. | ..... | 72/247 |
| 5,061,337 | A * | 10/1991 | Fraser | ..... | 156/351 |
| 5,156,076 | A * | 10/1992 | Rosemann | ..... | 83/344 |
| 5,174,185 | A | 12/1992 | Aichele | | |
| 5,301,583 | A * | 4/1994 | Kakko-Chiloff | ..... | 83/344 |
| 5,498,148 | A * | 3/1996 | Ouellette et al. | ..... | 425/294 |
| 5,498,433 | A * | 3/1996 | Ouellette | ..... | 426/502 |
| 5,720,210 | A * | 2/1998 | Okahashi | ..... | 83/342 |
| 6,244,148 | B1 | 6/2001 | Vees | | |
| 7,299,729 | B2 * | 11/2007 | Cox | ..... | 83/343 |

FOREIGN PATENT DOCUMENTS

| | | |
|---|---|---|
| DE | 3 229 948 | 2/1984 |
| EP | 0 899 068 | 3/1999 |
| WO | 91/17027 | 11/1991 |

* cited by examiner

*Primary Examiner* — Laura M. Lee
(74) *Attorney, Agent, or Firm* — Drinker Biddle & Reath LLP

(57) ABSTRACT

A rotary cutting unit includes a rotary cutter overlying a rotatable anvil. The anvil includes an axle, at least one anvil portion adapted to co-operate with a knife member of a rotary cutter, and a pair of load transmitting portions adapted to abut a pair of abutment members of the rotary cutter. The pair of load transmitting portions are arranged on each side of the anvil portion. A load receiving member is provided between each load transmitting portion and the anvil portion. Each of the load receiving members is connected to the axle via a bearing. Fluid cylinders apply upward forces to the load receiving members, wherein the total upward force exceeds the weight of the anvil.

9 Claims, 6 Drawing Sheets

ANVIL FOR A ROTARY CUTTING UNIT AND A ROTARY CUTTING UNIT HAVING SUCH ANVIL

The present application claims priority under 35 U.S.C. §119 to patent application Ser. No. 0401735-6 filed in Sweden on Jul. 2, 2004.

TECHNICAL BACKGROUND OF THE INVENTION

The present invention relates to a rotatable anvil for a rotary cutting unit, comprising an axle, at least one anvil portion adapted to cooperate with a knife member of a rotary cutter and a pair of load transmitting portions adapted to abut a pair of abutment members of said rotary cutter, said pair of load transmitting portions being arranged on each side of said anvil portion.

The invention also relates to a rotary cutting unit comprising a rotary cutter and such a rotatable anvil.

Such a rotary cutting unit is known from U.S. Pat. No. B-6,244,148, and comprises a rotary cutter in working relationship with a rotary anvil. The rotary cutter is provided with a substantially circular-cylindrical body having a cylindrical cutting surface and at least one knife member protruding from said surface, the radially peripheral part of said knife member having a diameter larger than that of said surface. Each side of the rotary cutter is provided with an axle supported in bearings. Between the axles and the surface, i.e. on each side of said surface, a pair of annular abutment members are provided. The abutment members have a diameter larger than that of said surface, in order to allow abutment against a pair of load receiving portions of the anvil.

The anvil is provided with an anvil portion and said pair of load receiving portions. The anvil portion is adapted to cooperate with the knife member of the rotary cutting drum, whereas the load receiving portions are adapted to abut said abutment members of the rotary cutter. The anvil is supported in bearings outside the anvil portion and outside the load bearing portions, as seen in the axial extension of the anvil.

Furthermore, the abutment members have a diameter which is substantially the same as the radially peripheral part of said knife member. The abutment members are adapted to lie against and transmit load such that a predetermined pressure is exerted on the load receiving portions of the anvil to achieve a desired cutting property. Optionally, the abutment may also transmit rotation of the rotary cutter drum to said anvil surface, such that it turns in a direction opposite to that of said rotary cutter.

A product is cut from a web introduced between the drums by the centrally arranged knife member.

The described rotary cutter however suffers from the drawback that the portions of the knife members in the axial center of the rotary cutting drum do not cut as precisely as the portions of the knife members closer to the axial periphery thereof. This is due to the fact that the rotary cutting drum exerts a pressure onto the anvil surface via the abutment members, thereby causing the anvil to be bent. This is shown in FIG. 6, illustrating the principle of a prior art anvil A corresponding to the anvil disclosed in U.S. Pat. No. A-6,244,148. A pair of load receiving portions B are arranged on respective sides of the axial extension of an anvil portion C, whereas a pair of annular support surfaces D for cooperating with bearings are arranged on either sides of the pair of load receiving portions B. When load E is applied to the load receiving portions, the central portion of the anvil A will be bent slightly downwards as shown (exaggerated) by the broken line F due to the counter directed force G on the surface D, i.e. at the bearings. Such bending may be denoted negative bending.

Another prior art rotary cutting unit has an anvil for cooperation with a rotary cutting drum having two or more knife members arranged side by side. Such a rotary cutter not only suffers from the drawback described above, but also in that it has a long axial extension, causing the anvil drum and the rotary cutting drum to also be bent by gravity, i.e. the longer and heavier the anvil, the more it will be bent negatively by gravity that will add to the described effect.

The use of two or three parallel knife members or one large knife member on a long rotary cutter to cooperate with such an anvil will thus only have acceptable cutting properties at the peripheral portion of the anvil, whereas the knife member closer to the central portions may not cut through the web to be cut.

SUMMARY OF THE INVENTION

Objects of the invention are to increase the reliability and the life time of the anvil.

This is achieved by a rotatable anvil and a rotary cutting unit, respectively, as initially defined, wherein a load receiving member is provided between said pair of load transmitting portions and said anvil portion, each of said load receiving members being connected to the axle via a bearing.

Hereby, undesired deformations of the rotary cutter and the anvil are compensated when increasing the load.

Preferably, a single anvil portion is provided. Hereby is achieved that the magnitude of the positive bending of the anvil can be defined by selecting the ratio of the inner anvil sleeve member, the length of the anvil, the rotary die design and the cutting application.

Alternatively, a plurality of anvil portions are provided. Hereby is achieved that a plurality of anvil portions can be situated according to the position of a plurality of knife members.

Suitably, said rotary cutting drum is provided with an at least centrally disposed knife member, and wherein said anvil drum is provided with a single anvil member. Hereby is achieved that the bending is symmetrical relative to the centerline.

Alternatively, said rotary cutting drum is provided with a plurality of axially disposed knife members, and wherein said anvil drum is provided with a single anvil member. Hereby is achieved that the magnitude of the positive bending can be defined.

Alternatively, said rotary cutting drum is provided with a plurality of axially disposed knife members, and wherein said anvil drum is provided with a plurality of anvil member adapted to cooperate with at least one of said axially disposed knife members. Hereby is achieved that the negative deflection due to gravity can be minimized and therefore the total lifetime of the anvil portions can be increased.

DRAWING SUMMARY

In the following, the invention will be described more closely with reference to the appended drawings, in which FIG. 1 illustrates a first embodiment of a rotary cutting unit including a rotary cutter and an anvil;

DETAILED DESCRIPTION OF PREFERRED EMBODIMENTS

Figure 1:
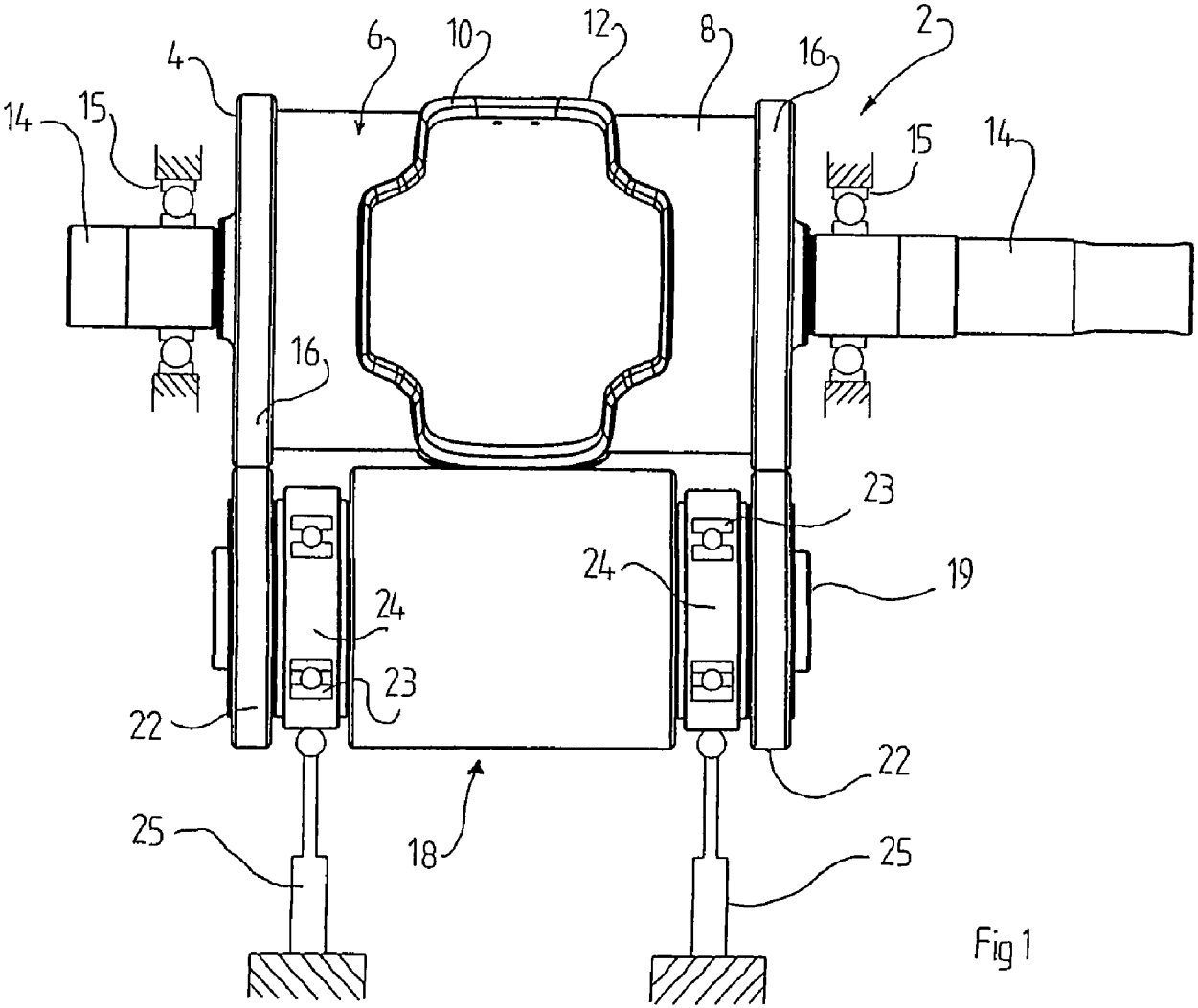

FIG. 1 shows a first embodiment of a rotary cutting unit 2 according to the invention. A rotary cutter 4 is provided with a substantially circular-cylindrical hollow or solid body 6 having a cylindrical surface 8 and at least one knife member 10 protruding from the surface 8. The radially peripheral part 12 of said knife member 10 has a diameter larger than that of said surface 8. The rotary cutter 4 is arranged on or is an integral part of an arbour 14 extending axially from each side of the rotary cutter 4 and being supported in bearings 15. Axially on each side of said surface 8, a pair of annular abutment members 16 are provided. The abutment members 16 have a diameter larger than that of said surface 8, in order to allow abutment against an anvil 18.

The anvil 18 includes an axle 19, an anvil portion 20 and a pair of load transmitting portions 22. The anvil portion 20 is adapted to cooperate with the knife member 10 of the rotary cutter 6, whereas the load transmitting portions 22 are adapted to abut said abutment surfaces 16 of the rotary cutter 6.

Furthermore, the abutment members 16 have a diameter which is substantially the same as the radially peripheral part 12 of said knife member 10.

Axially on each side of the anvil portion 20, the axle 19 is rotatably arranged in bearings 23, each surrounded by a non-rotary load receiving member 24. The load receiving members 24 are arranged axially inside the load transmitting portions 22, i.e., each load receiving portion is located axially between the anvil portion 20 and each load transmitting portion 22.

An upward load is applied by a pair of pneumatic cylinders 25 to the load receiving members 24. The load is transmitted further via the load transmitting portions 22 to the abutment members 16.

Figure 2:
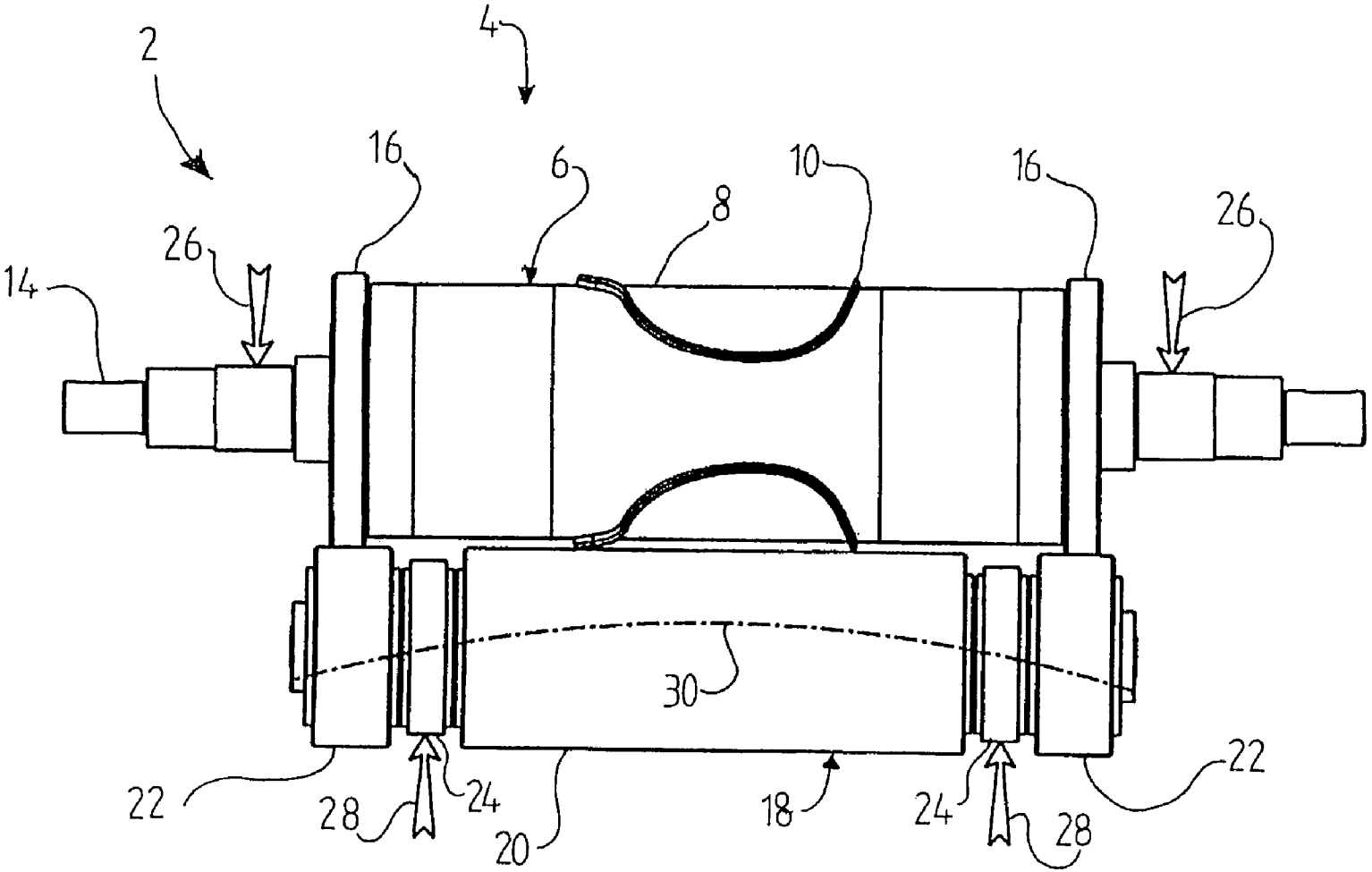
FIG. 2 illustrates an anvil according to the invention subjected to a load.

In FIG. 2, an anvil 18 having a greater axial extension than that of the anvil of FIG. 1 is shown for a better understanding of the invention. An upward load 28 is transmitted via the load transmitting portions 22 to the abutment members 16, the total upward load being greater than the weight of the anvil and sufficient to cause the anvil 18 to be bent towards the rotary cutter 4, resulting in the cutting properties being improved especially in the axially central portions of the knife members 10 (e.g., see FIG. 2). The load of course causes a counter directed force at the surface 8 which is transmitted to the bearings 15 to produce force 26. The load causes the anvil to be bent slightly upwards as shown (exaggerated) by the broken line 30.

The load applied by the pair of pneumatic cylinders 25 is adjusted by performing a cutting operation and checking the cutting result. If the cutting result is not the desired, the pressure is increased or decreased, until the cut is uniform over the whole extension of the rotary cutter 4 and the anvil 18.

The optimal cut will in fact be achieved when the anvil 18 is straight, i.e. when the line 30 is straight, since the abutment members 16 and the knife members 12 protrude substantially to the same extent above the surface 8 and will have constant cutting properties along the whole anvil portion 20.

Figure 3:
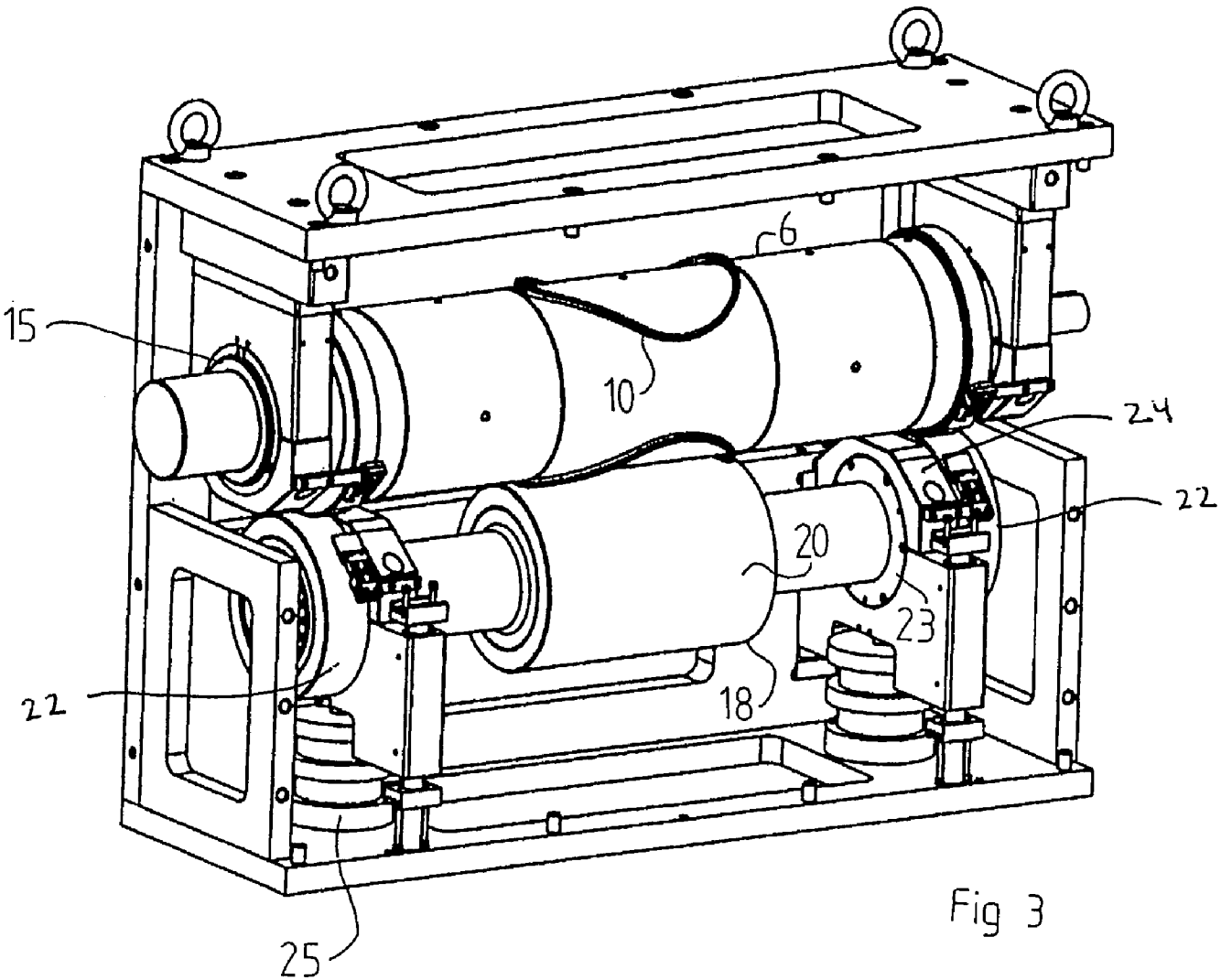
FIG. 3 illustrates a rotary cutting unit according to a second embodiment.

FIG. 3 shows a second embodiment of a rotary cutting unit. The anvil and the rotary cutter drums are long and are even more affected by gravity such that they are bent towards the ground. However, when the load transmitting portions 22 exert pressure on the abutments members 16, the anvil 18 will be bent towards the rotary cutter 6. Thus, when the pressure has been adjusted such that the line 30 (see FIG. 2) is straight, the cutting properties will be substantially equal over the whole extension of the knife members 10.

Thus, by exerting pressure 28 on the load receiving members 24, it will be possible to utilise also such a centrally disposed knife member.

Alternatively, a knife member on a long rotary cutting drum may extend substantially from one side to the other of the cutting drum, with maintained cutting properties.

Figure 4:
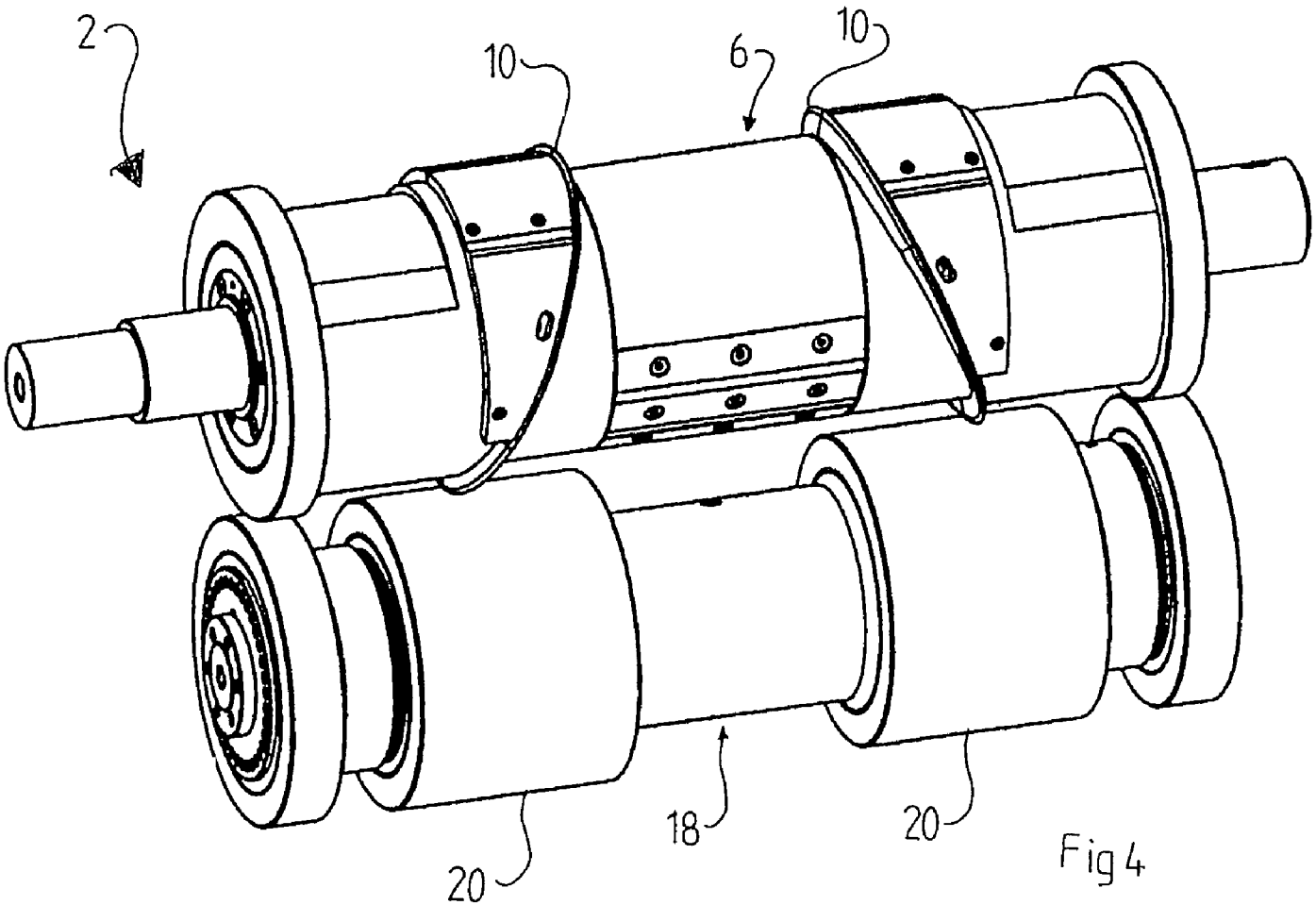
FIG. 4 illustrates a rotary cutting unit according to a third embodiment.

FIG. 4 shows a third embodiment of a rotary cutting unit 2 having a rotary cutter 6 with a pair of knife members 10 arranged axially separated. The anvil is divided into two separate anvil portions 20 corresponding to said knife members.

Figure 5:
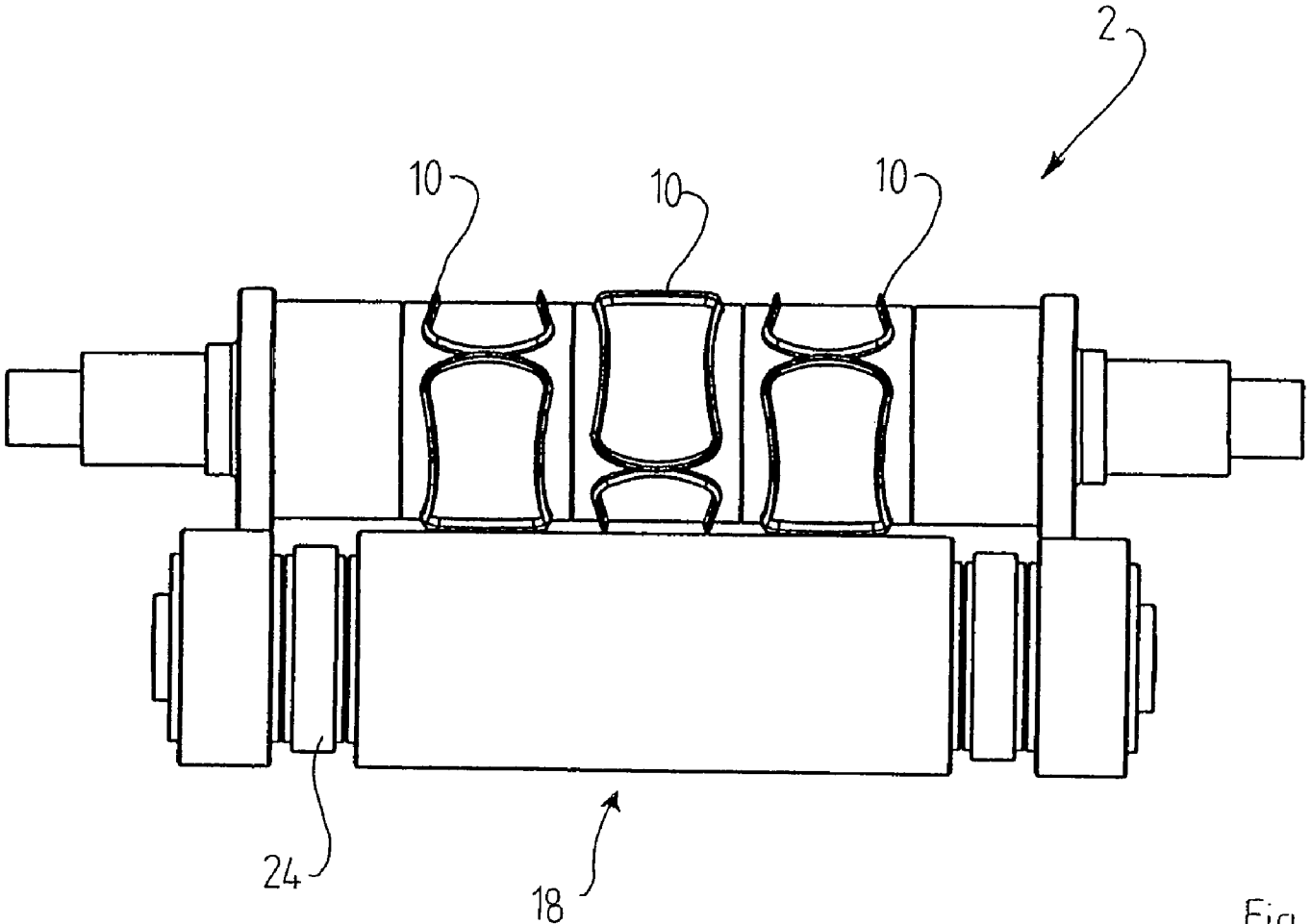
FIG. 5 illustrates a rotary cutting unit according to a fourth embodiment.
Figure 6:
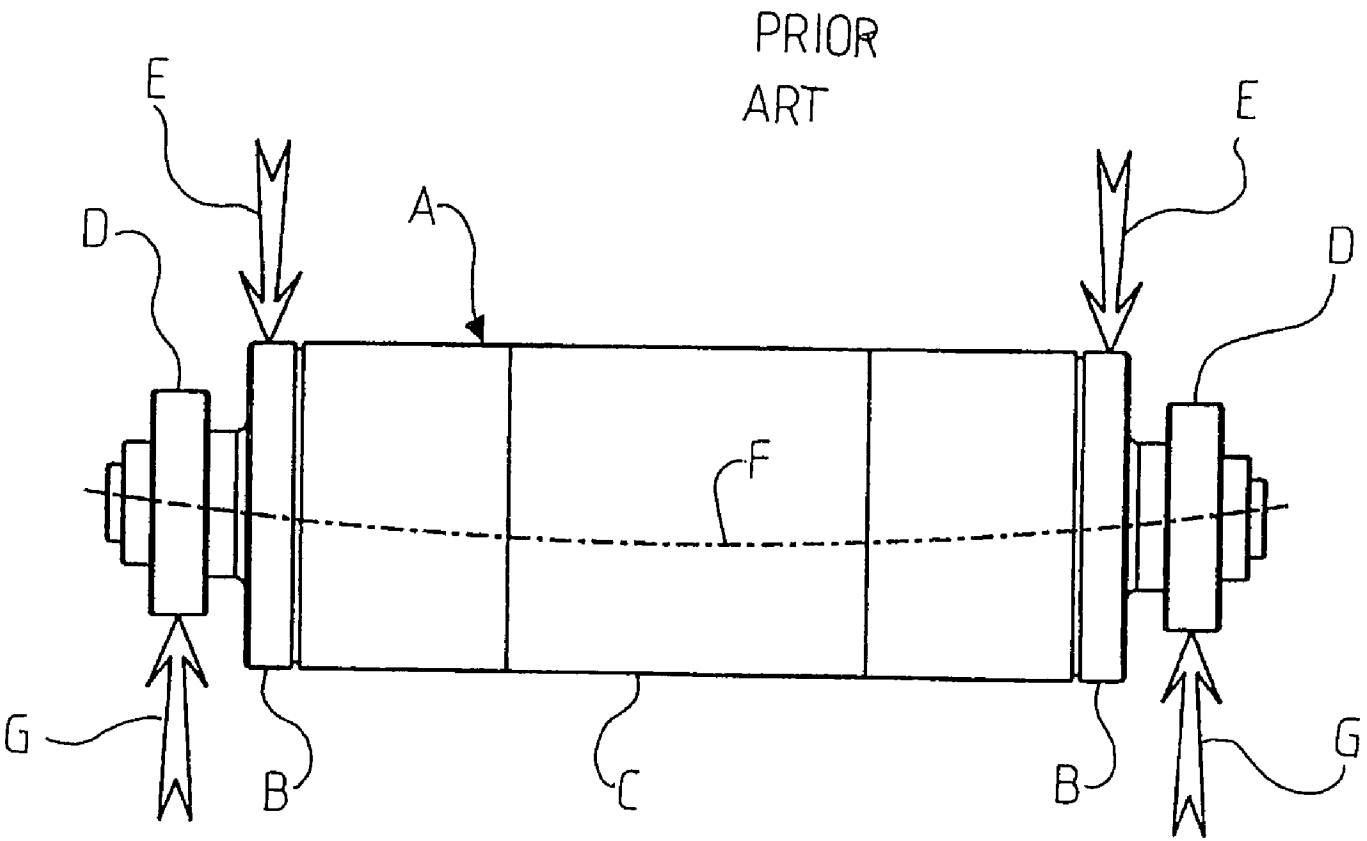
FIG. 6 illustrates a prior art anvil subjected to a load.

FIG. 5 shows a fourth embodiment, according to which the rotary cutter 6 is provided with a three axially adjacent knife members 10, whereas the anvil 18 is provided with a single anvil portion 20 only. By means of such a rotary cutter, it is possible to cut three articles simultaneously. Of course, less or more than three knife members may be arranged in parallel.

Of course, only one or more than two pneumatic cylinders 25 may be utilised. Alternatively or additionally, hydraulic cylinders or mechanical loading e.g., via spindles and wedges may be utilized.

Although the present invention has been described in connection with preferred embodiments thereof, it will be appreciated by those skilled in the art that additions, modifications, substitutions and deletions not specifically described may be made without departing from the spirit and scope of the invention as defined in the appended claims.

What is claimed is:

1. A rotary cutting unit comprising a rotary cutting drum and an anvil arranged therebeneath;

said cutting drum comprising at least one knife member disposed between a pair of axially spaced abutment members;

said anvil comprising an axle rotatably positioned in a set of bearings, at least one rotatable anvil portion arranged opposite the at least one knife member, and a pair of load transmitting portions abutting respective ones of said abutment members and positioned axially outward of the set of bearings, and non-rotating load receiving members disposed concentrically with the axle between said at least one rotatable anvil portion and respective ones of said load transmitting members, each of said non-rotating load receiving members connected to said axle by a respective one of said bearings; and a load applying mechanism arranged to apply to the non-rotating load receiving members a variable upward force, wherein the load transmitting portions transmit an upward load from the load applying mechanism to the abutment members.

2. The rotary cutting unit according to claim 1 wherein said at least one knife member consists of a centrally-disposed knife member and said at least one anvil portion consists of a single anvil portion.

3. The rotary cutting unit according to claim 1 wherein said at least one knife member comprises a plurality of axially spaced knife members, and said at least one anvil portion comprises a plurality of axially spaced anvil portions.

4. The rotary cutting unit according to claim 1 wherein said at least one knife member comprises a plurality of axially spaced knife members, and said at least one anvil portion consists of a single anvil portion.

5. The rotary cutting unit according to claim 1 wherein the load applying mechanism comprises fluid-actuated cylinders engaging respective non-rotating load receiving members.

6. The rotary cutting unit according to claim 1, wherein the pair of abutment members of the rotary cutter have a diameter larger than a surface of the rotary cutter from which a knife member protrudes.

7. The rotary cutting unit according to claim 1, wherein the upward force is sufficient to slightly bend upward a center region of the rotatable anvil portion.

8. The rotary cutting unit according to claim 1, wherein each non-rotating load receiving member encircles a portion of the axle.

9. The rotary cutting unit according to claim 1, wherein the bearings are surrounded by the non-rotating load receiving members.

* * * * *